US009280938B2

(12) United States Patent
Fleck et al.

(10) Patent No.: US 9,280,938 B2
(45) Date of Patent: Mar. 8, 2016

(54) TIMED SEQUENCE MIXED COLOR DISPLAY

(75) Inventors: Rod G. Fleck, Bellevue, WA (US); Derek Leslie Knee, Fort Collins, CO (US)

(73) Assignee: Microsoft Technology Licensing, LLC, Redmond, WA (US)

( * ) Notice: Subject to any disclaimer, the term of this patent is extended or adjusted under 35 U.S.C. 154(b) by 398 days.

(21) Appl. No.: 12/978,173

(22) Filed: Dec. 23, 2010

(65) Prior Publication Data

US 2012/0162270 A1 Jun. 28, 2012

(51) Int. Cl.
*G09G 3/36* (2006.01)
*G09G 3/34* (2006.01)

(52) U.S. Cl.
CPC ..... *G09G 3/3413* (2013.01); *G09G 3/3611* (2013.01); *G09G 2300/0452* (2013.01); *G09G 2310/0235* (2013.01); *G09G 2320/0242* (2013.01); *G09G 2320/0261* (2013.01); *G09G 2330/021* (2013.01)

(58) Field of Classification Search
CPC ..... G09G 3/22022–3/2037; G09G 3/2074; G09G 3/2077; G09G 3/364
USPC ..... 345/87–104
See application file for complete search history.

(56) References Cited

U.S. PATENT DOCUMENTS 7,508,358 B2 3/2009 Wada et al.
7,649,310 B2 1/2010 Ishii et al.
7,705,855 B2 4/2010 Brown Elliott
2004/0021677 A1* 2/2004 Sasaki et al. ..... 345/694
2005/0275777 A1 12/2005 Oizumi et al.
2006/0232545 A1* 10/2006 Sekiguchi ..... 345/102

(Continued)

FOREIGN PATENT DOCUMENTS

CN 101017260 8/2007
TW 200828235 7/2008

OTHER PUBLICATIONS

Zhao, et al., "A 3 inch Active Matrix for Color Sequential—Liquid Crystal Display (CS-LCD) Based on Metal Induced Continuous Zonal Domain (CZD) Polycrystalline Silicon Technology", Retrieved at << http://www.cdr.ust.hk/publications/research_pub/2008/SID08_P015.pdf >>, SID Digest, 2008, pp. 1223-1226.

(Continued)

*Primary Examiner* — Sanghyuk Park
(74) *Attorney, Agent, or Firm* — Jeremy Snodgrass; Judy Yee; Micky Minhas

(57) ABSTRACT

In embodiments of mixed sequential color display, a light source sequentially generates different colors of light in a timed sequence. A display panel is implemented with multiple sub-pixel combinations, where each pixel of the display panel is a combination of sub-pixels that emit a color based on a color of the light that illuminates a sub-pixel combination. The emitted color from a sub-pixel combination is generated as a product of the color of the light and a combination of sub-pixel colors (to include clear and/or colored sub-pixels). The clear and/or different colored sub-pixels in a sub-pixel combination are a spatial aspect of the emitted color, and the sequentially generated different colors of light are a temporal aspect of the emitted color. The pixel combination and the light source together enhance the luminescence of the emitted color over the chrominescence of the emitted color.

20 Claims, 4 Drawing Sheets

(56) References Cited

U.S. PATENT DOCUMENTS

| | | | | |
|---|---|---|---|---|
| 2006/0284872 | A1* | 12/2006 | Brown Elliott | 345/426 |
| 2007/0109329 | A1* | 5/2007 | Roh et al. | 345/694 |
| 2007/0182682 | A1* | 8/2007 | Hong et al. | 345/88 |
| 2007/0182699 | A1 | 8/2007 | Ha et al. | |
| 2008/0122782 | A1* | 5/2008 | Qi | 345/102 |
| 2008/0158207 | A1* | 7/2008 | Weng et al. | 345/204 |
| 2008/0231577 | A1* | 9/2008 | Lin et al. | 345/90 |
| 2009/0021534 | A1* | 1/2009 | Tomizawa et al. | 345/690 |
| 2009/0128543 | A1 | 5/2009 | Sarma et al. | |
| 2009/0135129 | A1* | 5/2009 | Roth et al. | 345/102 |
| 2009/0231263 | A1 | 9/2009 | Liao et al. | |
| 2010/0309186 | A1* | 12/2010 | Minami et al. | 345/211 |
| 2011/0085098 | A1* | 4/2011 | Liao et al. | 349/37 |

OTHER PUBLICATIONS

Chen, et al., "Mixed Color Sequential Technique for Reducing Color Breakup and Motion Blur Effects", Retrieved at << http://ir.lib.nctu.edu.tw/bitstream/987654321/8591/1/010420030.pdf >>, Journal of Display Technology, vol. 3, No. 4, Dec. 2007, pp. 377-385.

"Foreign Office Action", CN Application No. 201110435874.6, Dec. 12, 2013, 13 pages.

"Foreign Office Action", CN Application No. 201110435874.6, Aug. 5, 2014, 15 Pages.

"Foreign Notice of Allowance", CN Application No. 201110435874.6, Jan. 6, 2015, 4 Pages.

* cited by examiner

TIMED SEQUENCE MIXED COLOR DISPLAY

BACKGROUND

A portable device, such as a mobile phone or computer device, may utilize a large amount of power to display a high-quality, full color image at 60 Hz. Generally, display technologies either directly generate various colors, such as an OLED display, or use white light through a gating structure, such as an LCD display underneath a color element or color filter, to generate an image. An exception is DLP projection displays that generate various colors utilizing a moving color wheel and fast moving mirrors. However, this display technology uses a 540 Hz refresh rate of cycles per color to avoid color breakup, which appears as image distortion. LCD displays that refresh at the traditional 60 Hz do not have the response time to operate at such high refresh rates. Field sequential color displays have advantages over traditional LCD displays, or other gated display technologies. However, power consumption can be much greater for high frame rates on the order of 350 Hz to avoid color break-up, which may still appear anyway when caused by motion during color rendering. Although field sequential panels can operate down to 180 Hz with an RGB sequence, better display quality is attained in a range of 240 Hz to 360 Hz.

SUMMARY

This summary is provided to introduce simplified concepts of mixed sequential color display that are further described below in the Detailed Description. This summary is not intended to identify essential features of the claimed subject matter, nor is it intended for use in determining the scope of the claimed subject matter.

Mixed sequential color display is described. In embodiments, a light source sequentially generates different colors of light (to include white light) in a timed sequence. A display panel is implemented with multiple sub-pixel combinations, where each pixel of the display panel is a combination of sub-pixels that emit a color based on a color of the light that illuminates a sub-pixel combination. The emitted color from a sub-pixel combination is generated as a product of the color of the light and a combination of sub-pixel colors (to include clear and/or colored sub-pixels). The clear and/or different colored sub-pixels in a sub-pixel combination are a spatial aspect of the emitted color, and the sequentially generated different colors of light are a temporal aspect of the emitted color. The pixel combination and the light source together may be implemented to enhance the luminescence of the emitted color over the chrominescence of the emitted color.

In other embodiments, the sub-pixel combinations can each include two different colored sub-pixels, a clear sub-pixel and a colored sub-pixel, three different colored sub-pixels, or a clear sub-pixel combined with two different colored sub-pixels. Alternatively, the pixel combinations can each include three different colored pixels, or a clear pixel and two different colored pixels. The pixels in a pixel combination can each be implemented for a percentage of illumination that is combined to emit the color based on the color of light that illuminates the pixel combination. The sub-pixels in a combination may not be equally proportionate in color, size, and/or illumination. The light source can be implemented as different color LEDs that sequentially generate the different colors of light in a timed sequence, and the timed sequences do not have to be of equal duration. The display panel can be implemented as an LCD panel, and the pixel combinations are each driven at a display rate along with the sequentially generated different colors of light to mask color breakup.

BRIEF DESCRIPTION OF THE DRAWINGS

Embodiments of mixed sequential color display are described with reference to the following drawings. The same numbers are used throughout the drawings to reference like features and components.

DETAILED DESCRIPTION

Embodiments of mixed sequential color display are described, and may be utilized for an implementation of a transparent display or for an implementation of a conventional display, such as an LCD panel. A portable device, such as a mobile phone or computer device, has a display device that includes a light source and a display panel. The display panel has multiple sub-pixel combinations, where each pixel of the display panel is a combination of two or three sub-pixels. In various embodiments, a sub-pixel combination may include two different colored sub-pixels, a clear sub-pixel and a colored sub-pixel, three different colored sub-pixels, or a clear sub-pixel combined with two different colored sub-pixels. The clear and/or different colored sub-pixels in a sub-pixel combination collectively emit a color when illuminated by the light source, which can be implemented as sequentially activated LEDs. A mixed color sequential display incorporates an average of both spatial and temporal color generation, where the colors of a sub-pixel combination are a spatial aspect of the emitted color, and the sequentially generated different colors of light are a temporal aspect of the emitted color.

Using a combination of color filters and time-sequenced LED backlights, overall costs for the number of color filter layers is reduced, cell timing requirements is reduced to fewer cycles, and picture quality for sequential color solutions is improved. The mixed combinations of LED backlights and color filters provides optimization for luminescence, eye color sensitivity, and pixel gate speeds. For example, a slower LCD display or other gating display technology can be implemented as a mixed sequential color display for minimal color breakup, improved power consumption, and optionally, may be utilized as a transparent display.

While features and concepts of the described systems and methods for mixed sequential color display can be implemented in any number of different environments, systems, devices, and/or various configurations, embodiments of mixed sequential color display are described in the context of the following example devices, systems, and configurations.

Figure 1:
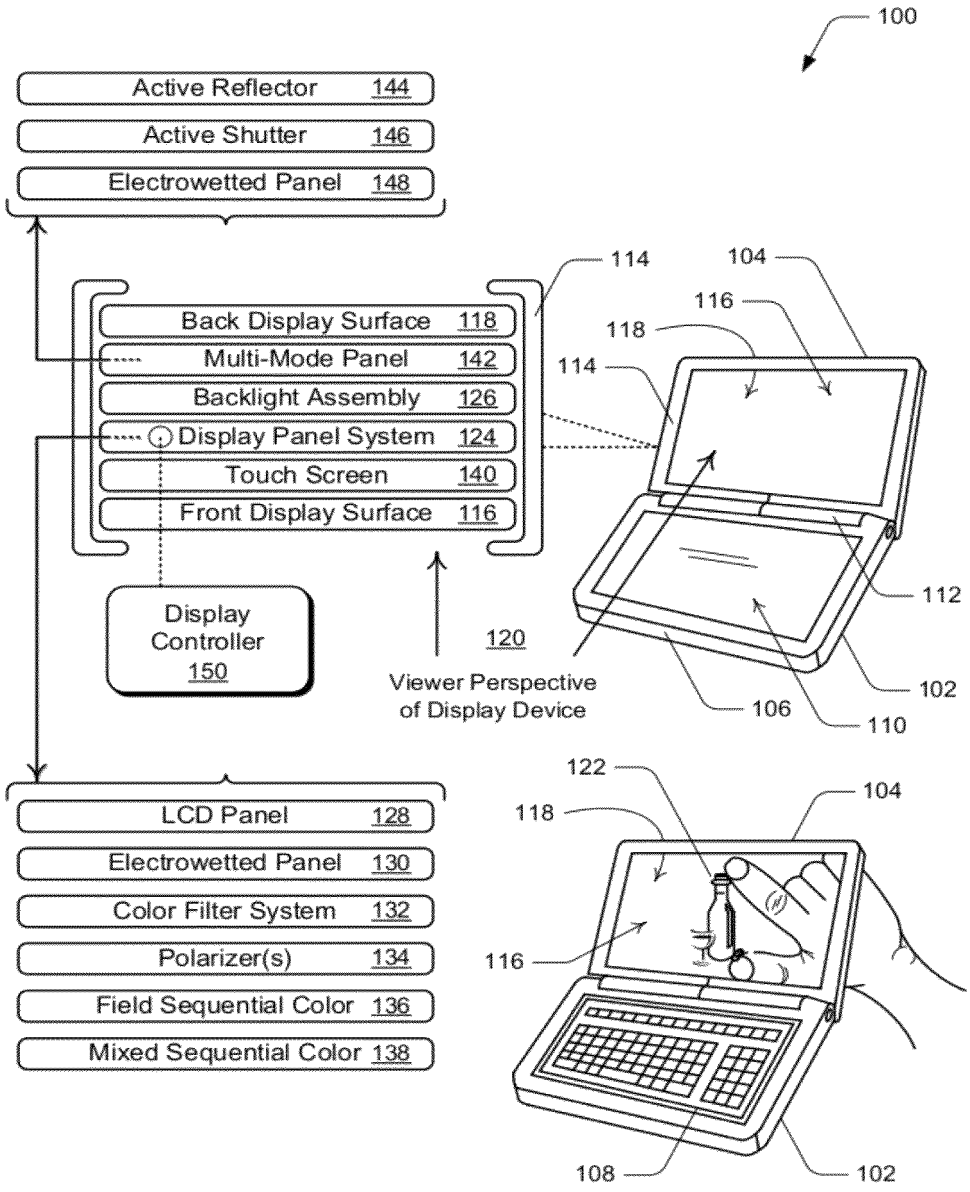
FIG. 1 illustrates examples of a portable device and display assembly in accordance with one or more embodiments of mixed sequential color display.

FIG. 1 illustrates examples 100 of a portable device 102 in accordance with embodiments of mixed sequential color display. The portable device includes a display device 104 and a handheld base 106 that may include a physical keyboard (shown at 108) or an additional display device 110 as an integrated component of the portable device. The additional display device may be utilized to display text, graphics, images, user interfaces, and/or a virtual keyboard, such as when an implementation of a portable device does not include a physical keyboard. In the examples, the display device 104 is movably coupled at 112 to the handheld base of the portable device, such as with a rotating hinge, slide track, flip mechanism, or other coupling device. The display device can open and close over the handheld base, such as when folded, slid, or flipped closed over the additional display device, folded around to the back of the handheld base, or any position in-between approximately zero degrees (0°) and three-hundred sixty degrees (360°) relative to the handheld base.

The display device 104 includes a display housing 114 that supports various display panels and surfaces that may be utilized to assemble the display device. In this example, the display device includes a front display surface 116, and includes a back display surface 118. The front display surface and the back display surface are viewable from opposite sides of the display device. A user of the portable device 102 may generally view the display device 104 through the front display surface 116, shown for reference as a viewer perspective of the display device at 120.

The display device 104 may be implemented as a conventional LCD panel, and both the front and back display surfaces, as well as the additional display device 110, can be implemented as a mixed sequential color display. Optionally, the display device may also be implemented as transparent display, in which case a displayed image 122 may be viewable through the front and back display surfaces. As described herein, the transparency of a display device may be a percentage of transparency as measured and/or visually perceived by a user. In the illustrated example, a hand may be viewable through the front and back display surfaces of the display device, such as when viewed through the front of the display device. An environment behind the display device can also be viewable through the front and back display surfaces of the display device, and a displayed image may appear projected into the environment for an augmented view of the environment.

In addition to the front display surface 116 and the back display surface 118, the display device 104 includes a display panel system 124 that is located between the front and back display surfaces. The display panel system is implemented to display images that are then viewable through the front and/or back display surfaces of the display device. The display device includes a backlight assembly 126 that illuminates the display panel for image display. The backlight assembly can include a light source to generate light, a backlight panel or light guide that directs the light to illuminate the display panel, and/or a diffuser that scatters and diffuses the light to uniformly illuminate the display panel.

In various embodiments, the display panel system 124 may include any one or combination of an LCD panel 128, an electrowetted panel 130, a color filter system 132 that may be implemented as a passive or active system, one or more polarizers 134 that may be implemented as passive or active, an implementation of field sequential color 136, and/or an implementation of mixed sequential color 138. The LCD panel 128 may be implemented as a transparent panel, an implementation can include polarizers, and may include an implementation of mixed sequential color. The color filter system 132 and the polarizers 134 can each be implemented for a percentage of transparency that permits an image being viewable through the display device.

In this example, the display device also includes a touch screen 140 that is located between the front and back display surfaces to sense a touch input to either of the front display surface or the back display surface. Alternatively, the display device may include a first touch screen located proximate the front display surface and a second touch screen located proximate the back display surface, and the touch screens sense touch inputs to the respective front and back display surfaces.

The display device 104 also includes a multi-mode panel 142 located between the front display surface 116 and the back display surface 118. In embodiments, the multi-mode panel is operable to switch on and off, such as to prevent an image from being viewable through the back display surface, or for transparency to permit the image being viewable through the display device. The multi-mode panel may be implemented to switch on and/or off the entire panel, sections of the panel, and/or individual pixels of the panel. The multi-mode panel may include any one or combination of an active reflector 144, an active shutter 146, and/or an implementation of an electrowetted panel 148 (e.g., implemented as an active reflector).

The display device 104 also includes a display controller 150 that is implemented to control display modes of the display device. The display controller can be implemented as computer-executable instructions, such as a software component, and executed by one or more processors to implement various embodiments for mixed sequential color display. In practice, the portable device 102 is implemented with a processor, a graphics processor unit, and an internal display controller to drive display content to the display device. In the display device 104, the display panel system 124 may include the display controller 150 that drives each pixel according to the type of display at various voltages.

The portable device 102 may be configured as any type of client or user device that includes fixed or mobile, wired and/or wireless devices, and may be implemented as a consumer, computer (e.g., a laptop or tablet device), portable, communication, phone (e.g., a dual-display phone), appliance, gaming, media playback, and/or electronic device. The portable device can be implemented with one or more processors, data communication components, memory components, navigation components, data processing and control circuits, and a display system. Further, any of the portable devices described herein can be implemented with any number and combination of differing components as further described with reference to the example device shown in FIG. 4.

Figure 2:
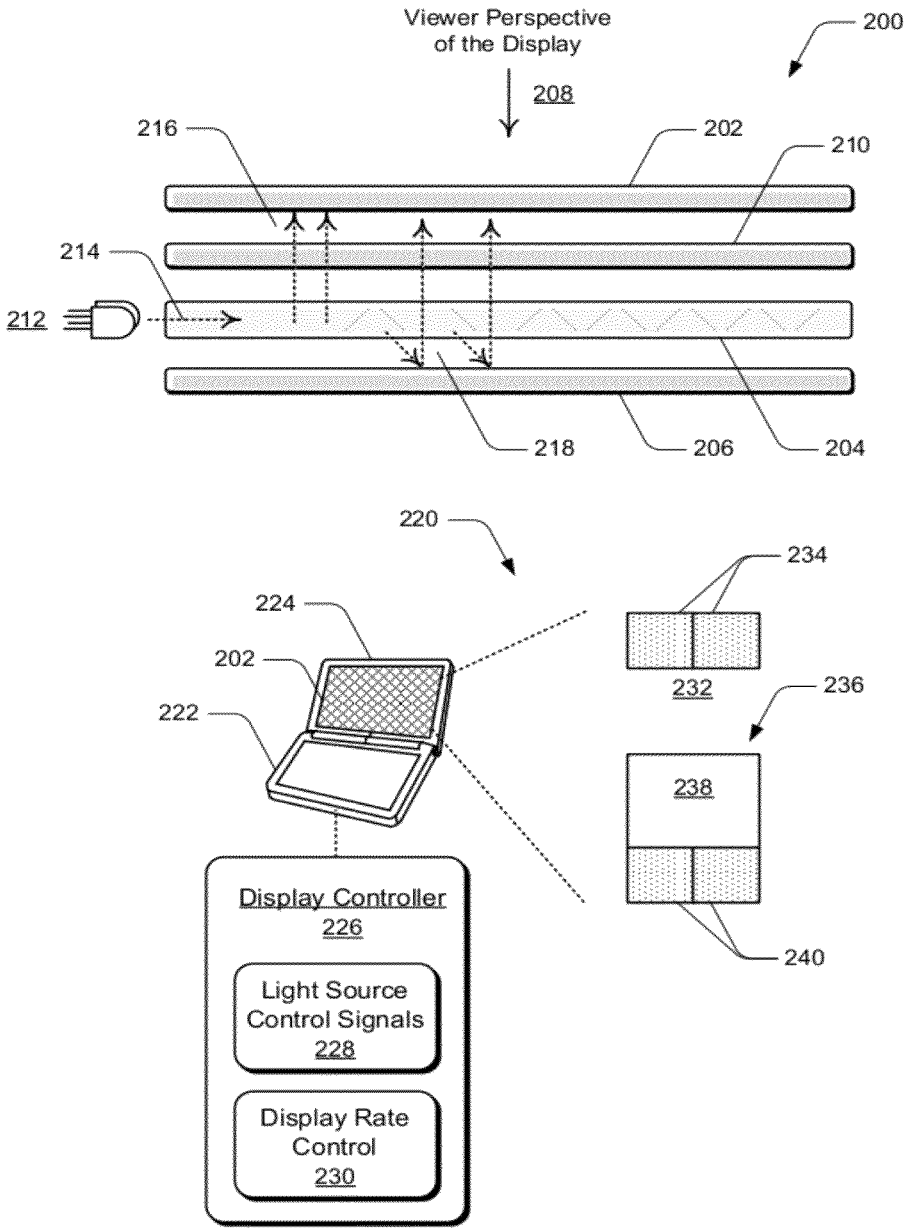
FIG. 2 illustrates examples of display components and mixed sequential color display in accordance with one or more embodiments.

FIG. 2 illustrates examples 200 of display components in embodiments of mixed sequential color display. The display components include a display panel 202, such as described with reference to the display panel system, as well as a light guide 204 and a multi-mode panel 206 as described with reference to the display device shown in FIG. 1. An orientation reference at 208 indicates a viewer perspective of the display panel, such as when a user of a device that includes the display components views the display panel. The display panel can be implemented as an LCD panel and the display components include a diffuser 210 that is implemented to uniformly scatter and/or diffuse the light that illuminates the display panel. The display components also include a light source 212 that generates light 214, which is directed in the light guide to illuminate the display panel at 216. The multi-mode panel 206 can be implemented as a conventional reflector panel, and lost light that is generated by the light source and directed away from the display panel is reflected at 218 to further illuminate the display panel 202.

In embodiments, the light source 212 is implemented to generate different colors of light in a timed-sequence, such as two different colors of LEDs that generate the different colors of light. The display panel 202 is implemented with multiple sub-pixel combinations, where each pixel of the display panel is a combination of two or three sub-pixels that emit a color based on a color of light from the light source that illuminates a sub-pixel combination. In an implementation, the display panel is an LCD panel, and the sub-pixel combinations are each driven at a display rate along with the sequentially generated different colors of light to mask color breakup.

A detail view 220 illustrates a portable device 222 that includes a display device 224 with the display panel 202. The portable device includes a display controller 226, such as described with reference to FIG. 1. The display controller is implemented to generate control signals 228 to activate the light source 212 and sequentially generate the different colors of light. The display controller is also implemented for display rate control 230 of the display panel. The detail view 220 also illustrates examples of sub-pixel combinations of the display panel that are alternate pixel structures from the traditional three-color filter designs and standard field sequential color, single pixel cell designs.

A mixed sequential color display implemented with the sub-pixel combinations reduces LCD panel or other gating element switching speeds that would otherwise be needed for acceptable image quality, such as in the two (2) ms to eight (8) ms range. A sub-pixel combination 232 is a pixel that includes two sub-pixels 234 that can be implemented as two different colored sub-pixels, or as a clear sub-pixel and a colored sub-pixel. For example, the light source 212 is LEDs that sequentially generate a combination of red and blue light, and then green light, and the sub-pixel combination 232 includes a yellow sub-pixel and a cyan sub-pixel. Another dual-cell sub-pixel structure may include yellow (as a combination of green+red) and cyan (as a combination of blue+green) color filters along with the LED backlight dual-phase timing of red+blue (50%) and Green (50%). The light source can be implemented with any two different colors of LEDs to generate the different colors of light, such as a combination of the colors white and yellow, etc.

Another pixel sub-combination 236 of the display panel is a pixel that can be implemented as three different colored sub-pixels, or as a clear sub-pixel 238 and two different colored sub-pixels 240. For example, the light source is LEDs that sequentially generate green light and white light, and the sub-pixel combination 236 includes the clear sub-pixel 238, as well as a red sub-pixel and a blue sub-pixel. The sub-pixels of a combination are each configured for a percentage of illumination that are combined to emit a color based on the color of light that illuminates the sub-pixel combination. The sub-pixels in a combination may not be equally proportionate size. As illustrated in the example sub-pixel combination 236, the clear sub-pixel 238 is approximately 50% of the illumination to emit the color from the sub-pixel combination. Another triple-cell sub-pixel structure may include white (or clear as approximately 50% of the area of the sub-pixel combination), red (25%), and blue (25%) color filters with LED backlight dual-phase timing of white (50%) and green (50%). Alternatively, a triple-cell sub-pixel structure may include yellow (25%), cyan (25%), white (50% clear) along with the LED backlight dual-phase timing of red+blue (50%) and green (50%). All of the sub-pixel percentages of color, size, and/or illumination described herein are approximate. In practice, the percentage of color, size, and/or illumination of the sub-pixels in a combination can be implemented for any color, size, and/or illumination.

A majority of colors can be created with the sub-pixel combinations and controlled gating of the sequentially generated different colors of light. A slower timing is also possible with two-cycle color generation. Because the eye is most sensitive to the color green, the sub-pixel combinations can be implemented to provide more pronounced greens during the two available cycles. Additionally, the eye is also most sensitive to luminescence, and the sub-pixel combinations can be implemented to provide greater illumination through either the white or clear sub-pixels with no color filter or negative filters, such as yellow and cyan which may reduce the luminescence loss per color filter.

In embodiments, a sub-pixel combination and the light source are designed to enhance the luminescence (e.g., brightness) of an emitted color over the chrominescence (e.g., color) of the emitted color. Further, the colors of a sub-pixel combination are a spatial aspect of the emitted color, and the sequentially generated different colors of light are a temporal aspect of the emitted color. For example, the clear and colored sub-pixels of the sub-pixel combination 236 remain constant (e.g., the spatial aspect), while the light source sequentially generates the different colors of light (e.g., the temporal aspect).

Example method 300 is described with reference to FIG. 3 in accordance with one or more embodiments of mixed sequential color display. Generally, any of the functions, methods, procedures, components, and modules described herein can be implemented using software, firmware, hardware (e.g., fixed logic circuitry), manual processing, or any combination thereof. A software implementation represents program code that performs specified tasks when executed by a computer processor. The example methods may be described in the general context of computer-executable instructions, which can include software, applications, routines, programs, objects, components, data structures, procedures, modules, functions, and the like. The program code can be stored in one or more computer-readable memory devices, both local and/or remote to a computer processor. The methods may also be practiced in a distributed computing environment by multiple computer devices. Further, the features described herein are platform-independent and can be implemented on a variety of computing platforms having a variety of processors.

Figure 3:
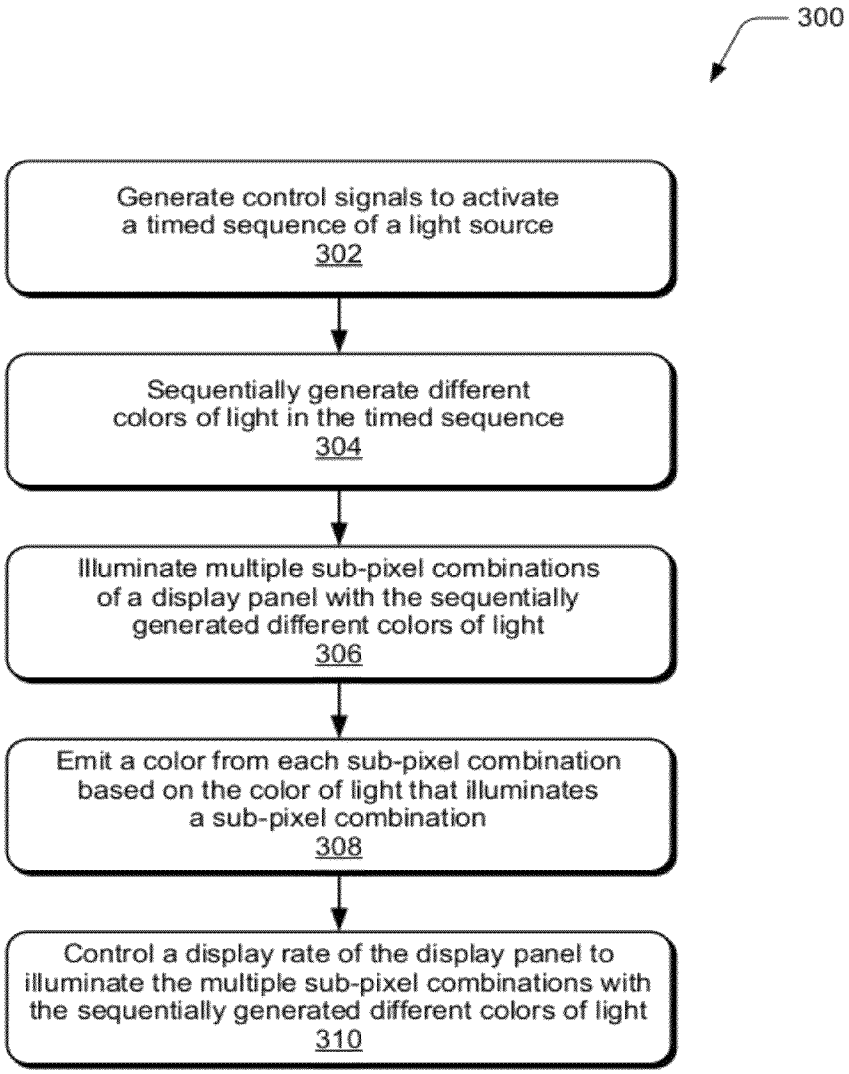
FIG. 3 illustrates example method(s) of mixed sequential color display in accordance with one or more embodiments.

FIG. 3 illustrates example method(s) 300 of mixed sequential color display. The order in which the method blocks are described are not intended to be construed as a limitation, and any number of the described method blocks can be combined in any order to implement a method, or an alternate method.

At block 302, control signals are generated to activate a timed sequence of a light source. For example, the display controller 226 generates control signals 228 to activate a timed sequence of the light source 212 (FIG. 2), such as to sequence different colors of LEDs that generate different colors of light to illuminate a display panel implemented as a mixed sequential color display. At block 304, different colors of light are sequentially generated in the timed sequence. For example, the LEDs implemented as the light source 212 sequentially generate the different colors of light 214 in a timed sequence.

At block 306, multiple sub-pixel combinations of a display panel are illuminated with the sequentially generated different colors of light. For example, the different colors of light 214 that are generated by the light source 212 illuminate the sub-pixel combinations 236 of the display panel 202. Colors are generated with the sub-pixel combinations and controlled gating of the sequentially generated different colors of light. At block 308, a color is emitted from each sub-pixel combination based on the color of light that illuminates a sub-pixel combination. For example, the color that is emitted from each of the sub-pixel combinations 236 is based on the color of light 214 from the light source 212 that illuminates a sub-pixel combination. The emitted color is generated as a product of the color of the light and a combination of sub-pixel colors.

At block 310, a display rate of the display panel is controlled to illuminate the multiple sub-pixel combinations with the sequentially generated different colors of light. For example, the display controller 226 controls the display rate of the display panel 202 to illuminate the multiple sub-pixel combinations 236 with the sequentially generated different colors of light.

Figure 4:
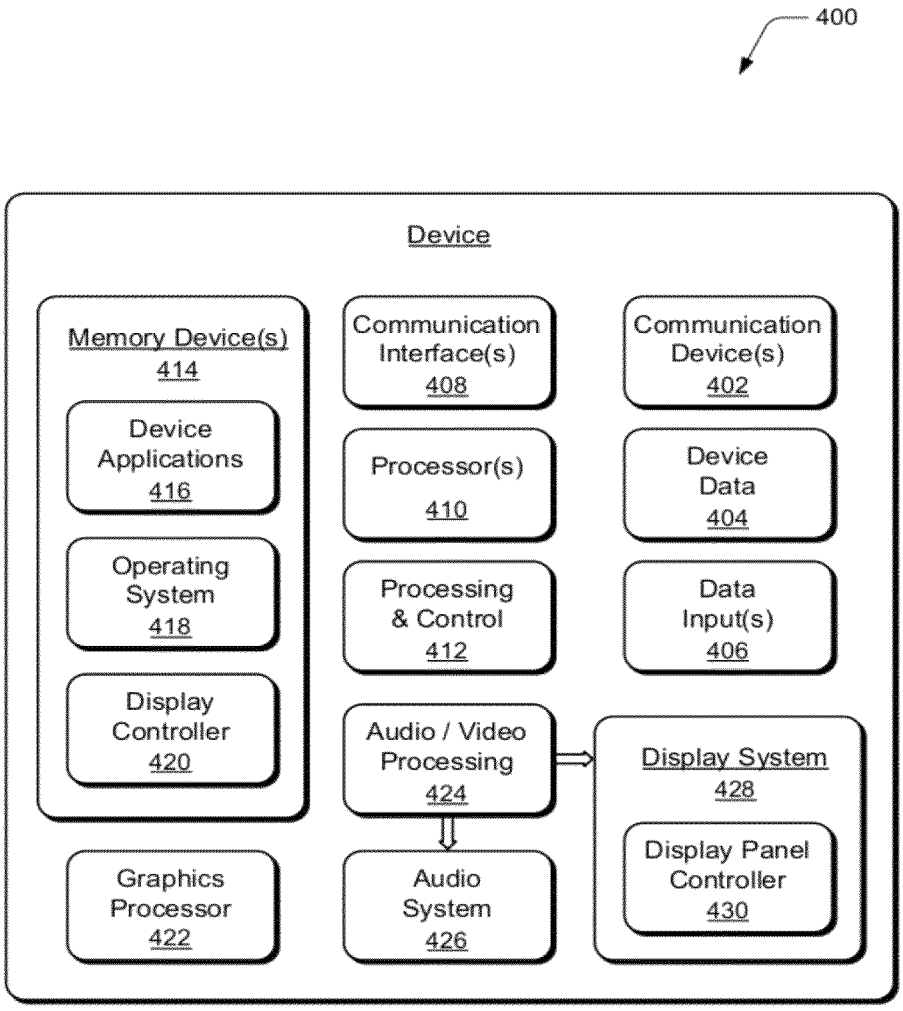
FIG. 4 illustrates various components of an example device that can implement embodiments of mixed sequential color display.

FIG. 4 illustrates various components of an example device 400 that can be implemented as a portable device as described with reference to any of the previous FIGS. 1-3. In embodiments, the device may be implemented as any one or combination of a fixed or mobile device, in any form of a consumer, computer, portable, user, communication, phone, navigation, television, appliance, gaming, media playback, and/or electronic device. The device may also be associated with a user (i.e., a person) and/or an entity that operates the device such that a device describes logical devices that include users, software, firmware, hardware, and/or a combination of devices.

The device 400 includes communication devices 402 that enable wired and/or wireless communication of device data 404, such as received data, data that is being received, data scheduled for transmission, data packets of the data, etc. The device data or other device content can include configuration settings of the device, media content stored on the device, and/or information associated with a user of the device. Media content stored on the device can include any type of audio, video, and/or image data. The device includes one or more data inputs 406 via which any type of data, media content, and/or inputs can be received, such as user-selectable inputs, messages, communications, music, television content, recorded video content, and any other type of audio, video, and/or image data received from any content and/or data source.

The device 400 also includes communication interfaces 408, such as any one or more of a serial, parallel, network, or wireless interface. The communication interfaces provide a connection and/or communication links between the device and a communication network by which other electronic, computing, and communication devices communicate data with the device.

The device 400 includes one or more processors 410 (e.g., any of microprocessors, controllers, and the like) which process various computer-executable instructions to control the operation of the device. Alternatively or in addition, the device can be implemented with any one or combination of software, hardware, firmware, or fixed logic circuitry that is implemented in connection with processing and control circuits which are generally identified at 412. Although not shown, the device can include a system bus or data transfer system that couples the various components within the device. A system bus can include any one or combination of different bus structures, such as a memory bus or memory controller, a peripheral bus, a universal serial bus, and/or a processor or local bus that utilizes any of a variety of bus architectures.

The device 400 also includes one or more memory devices 414 (e.g., computer-readable storage media) that enable data storage, such as random access memory (RAM), non-volatile memory (e.g., read-only memory (ROM), flash memory, etc.), and a disk storage device. A disk storage device may be implemented as any type of magnetic or optical storage device, such as a hard disk drive, a recordable and/or rewriteable disc, and the like.

Computer readable media can be any available medium or media that is accessed by a computing device. By way of example, and not limitation, computer readable media may comprise storage media and communication media. Storage media include volatile and non-volatile, removable and non-removable media implemented in any method or technology for storage of information, such as computer-readable instructions, data structures, program modules, or other data. Storage media include, but are not limited to, RAM, ROM, EEPROM, flash memory or other memory technology, CD-ROM, digital versatile disks (DVD) or other optical storage, magnetic cassettes, magnetic tape, magnetic disk storage or other magnetic storage devices, or any other medium which can be used to store information and which can be accessed by a computer.

Communication media typically embody computer-readable instructions, data structures, program modules, or other data in a modulated data signal, such as carrier wave or other transport mechanism. Communication media also include any information delivery media. The term modulated data signal means a signal that has one or more of its characteristics set or changed in such a manner as to encode information in the signal. By way of example, and not limitation, communication media include wired media such as a wired network or direct-wired connection, and wireless media such as acoustic, RF, infrared, and other wireless media.

A memory device 414 provides data storage mechanisms to store the device data 404, other types of information and/or data, and various device applications 416. For example, an operating system 418 and a display controller 420 can be maintained as software applications with a memory device and executed on the processors. The device applications may also include a device manager, such as any form of a control application, software application, signal processing and control module, code that is native to a particular device, a hardware abstraction layer for a particular device, and so on.

The device 400 may also include a graphics processor 422, and includes an audio and/or video processing system 424 that generates audio data for an audio system 426 and/or generates display data for a display system 428. The audio system and/or the display system may include any devices that process, display, and/or otherwise render audio, video, display, and/or image data. For example, the display system includes a display panel controller 430. Display data and audio signals can be communicated to an audio device and/or to a display device via an RF (radio frequency) link, S-video link, composite video link, component video link, DVI (digital video interface), analog audio connection, or other similar communication link. In implementations, the audio system and/or the display system are external components to the device. Alternatively, the audio system and/or the display system are integrated components of the example device.

Although embodiments of mixed sequential color display have been described in language specific to features and/or methods, the subject of the appended claims is not necessarily limited to the specific features or methods described. Rather, the specific features and methods are disclosed as example implementations of mixed sequential color display.

The invention claimed is:

1. A display device, comprising:

a light source configured to sequentially generate different colors of light in a timed sequence; and a display panel of multiple pixels that are each a combination of sub-pixels, each of sub-pixel combinations including only clear sub-pixels, yellow sub-pixels, and cyan sub-pixels, the yellow sub-pixels comprise an area of approximately 25% of each of the sub-pixel combinations, the cyan sub-pixels comprise an area of approximately 25% of each of the sub-pixel combinations, the clear sub-pixels comprise an area of approximately 50% of each of the sub-pixel combinations, the yellow sub-pixels comprise a combination of a green color filter and a red color filter, the cyan sub-pixels comprise a combination of a blue color filter and a green color filter, each of the sub-pixel combinations configured to emit an emitted color generated as a product of a color of light that illuminates a sub-pixel combination and a combination of sub-pixel colors.

2. A display device as recited in claim 1, wherein sub-pixel combination and the light source are further configured to enhance luminescence of the emitted color over chrominescence of the emitted color.

3. A display device as recited in claim 1, wherein the sub-pixel colors of the sub-pixel combination are a spatial aspect of the emitted color, and wherein sequentially generated the different colors of light are a temporal aspect of the emitted color.

4. A display device as recited in claim 1, wherein the display panel is an LCD panel, and wherein the sub-pixel combinations are each driven at a display rate along with sequentially generated the different colors of light to mask color breakup.

5. A display device as recited in claim 1, wherein the light source comprises at least two different colors of LEDs that generate the two different colors of light.

6. A display device as recited in claim 1, wherein the light source comprises LEDs that sequentially generate white light and green light, and wherein a total illumination from combined a sub-pixels emit color based on the color of light that illuminates the sub-pixel combination.

7. A display device as recited in claim 6, wherein the timed sequence utilizes an LED that generates green light for approximately 50% of the timed sequenced and wherein the timed sequence utilizes an LED that generates white light for approximately 50% of the timed sequence.

8. A display device as recited in claim 1, wherein the sub-pixel combinations include a triple-cell sub-pixel structure.

9. A display device as recited in claim 1, further comprising a memory and a processor to implement a display controller configured to generate control signals to control a display rate of the display panel.

10. A display device as recited in claim 1, further comprising a memory and a processor to implement a display controller configured to activate the timed sequence.

11. A device, comprising:

a light source configured to sequentially generate different colors of light in a timed sequence;

a display panel of multiple pixels that are each a combination of sub-pixels, each of the sub-pixel combinations including a yellow sub-pixel, a cyan sub-pixel, and a clear sub-pixel, and configured to emit a color based on a color of light that illuminates a sub-pixel combination, the yellow sub-pixel comprising a combination of a green color filter and a red color filter, and the cyan sub-pixel comprising a combination of a blue color filter and a green color filter, the yellow sub-pixel comprises an area of approximately 25% of the sub-pixel combination, the cyan sub-pixel comprises an area of approximately 25% of the sub-pixel combination, and the clear sub-pixel comprises an area of approximately 50% of the sub-pixel combination; and a memory and a processor to implement a display controller configured to generate control signals to control a display rate of the display panel, and to activate the timed sequence of the light source to sequentially generate the different colors of light.

12. A device as recited in claim 11, wherein the sub-pixel combination and the light source are further configured to enhance luminescence of the emitted color over chrominescence of the emitted color.

13. A device as recited in claim 11, wherein sub-pixel colors of the sub-pixel combination are a spatial aspect of the emitted color, and wherein sequentially generated different colors of light are a temporal aspect of the emitted color.

14. A device as recited in claim 11, wherein respective light sources comprise LEDs.

15. A device as recited in claim 11, wherein the sub-pixel combinations include a triple-cell sub-pixel structure.

16. A method, comprising:

sequentially generating different colors of light in a timed sequence, 50% of the timed sequence generating green light and 50% of the timed sequence generating a combination of red light and blue light, the green light, the blue light, and the red light being generated by respective light sources;

illuminating multiple sub-pixel combinations of a display panel that includes multiple pixels, where each pixel is a combination of sub-pixels including a yellow sub-pixel, a cyan sub-pixel, and a clear sub-pixel, the yellow sub-pixel comprising an area of approximately 25% of the sub-pixel combination, the cyan sub-pixel comprising an area of approximately 25% of the sub-pixel combination, and the clear sub-pixel comprising an area of approximately 50% of the sub-pixel combination, the yellow sub-pixel comprising a combination of a green color filter and a red color filter, the cyan sub-pixel comprising a combination of a blue color filter and a green color filter; and emitting from each sub-pixel combination an emitted color generated as a product of a color of light that illuminates a sub-pixel combination and a combination of sub-pixel colors.

17. A method as recited in claim 16, further comprising generating control signals to activate the timed sequence of the light source to sequentially generate the different colors of light.

18. A method as recited in claim 16, further comprising controlling a display rate of the display panel to illuminate the multiple sub-pixel combinations with the sequentially generated different colors of light.

19. A method as recited in claim 16, wherein the sub-pixel combinations and the light source are configured to enhance luminescence of the emitted color over chrominescence of the emitted color.

20. A method as recited in claim 16, wherein the sub-pixel colors of the sub-pixel combination are a spatial aspect of the emitted color, and wherein the sequentially generated different colors of light are a temporal aspect of the emitted color.

* * * * *